US008206232B2

(12) United States Patent
Johnston

(10) Patent No.: US 8,206,232 B2
(45) Date of Patent: Jun. 26, 2012

(54) AMUSEMENT APPARATUS

(76) Inventor: Roy Johnston, East Moline, IL (US)

( * ) Notice: Subject to any disclaimer, the term of this patent is extended or adjusted under 35 U.S.C. 154(b) by 1169 days.

(21) Appl. No.: 11/985,011

(22) Filed: Nov. 13, 2007

(65) Prior Publication Data

US 2008/0113605 A1 May 15, 2008

Related U.S. Application Data

(60) Provisional application No. 60/857,947, filed on Nov. 10, 2006.

(51) Int. Cl.
*A63G 31/00* (2006.01)

(52) U.S. Cl. ..... 472/137; 472/136; 273/447; 454/195; 454/370

(58) Field of Classification Search ..... 273/447; 472/137, 136; 454/195, 370
See application file for complete search history.

(56) References Cited

U.S. PATENT DOCUMENTS

| | | | | |
|---|---|---|---|---|
| 3,578,326 | A * | 5/1971 | Brown | 273/356 |
| 4,695,903 | A * | 9/1987 | Serap et al. | 386/359 |
| 5,479,787 | A * | 1/1996 | Carter et al. | 62/231 |
| 5,794,944 | A * | 8/1998 | Roberts | 273/447 |
| 6,042,490 | A * | 3/2000 | Lenhart | 473/415 |
| 6,086,380 | A * | 7/2000 | Chu et al. | 434/307 A |
| 6,805,558 | B1 * | 10/2004 | Carl et al. | 434/258 |
| 2007/0250878 | A1 * | 10/2007 | Ryckman et al. | 725/91 |
| 2008/0017084 | A1 * | 1/2008 | Beall | 109/23 |

OTHER PUBLICATIONS

Money Booth Rental, <http://vaultmoneybooth.com/index.html>, 2008.*

Money Blowing Booths, <http://www.promoquip.com/money-blowing-machine-booths.html>, 2010.*

Money Machine Cash Cube Rental, <http://www.funindustries.com/megacubebrochure.htm>, 2008.*

Money Machine and Cash Cube, <http://money-machine-cash-cube.com/hardcase.html>, 2006.*

* cited by examiner

*Primary Examiner* — David L Lewis
*Assistant Examiner* — Chase Leichliter
(74) *Attorney, Agent, or Firm* — Hamilton IP Law, PC; Jay R. Hamilton; Charles A. Damschen

(57) ABSTRACT

The amusement apparatus comprising a housing, a frame and an interior space, and a door allowing entry of a player having arms into interior space. An air circulation system fluidly connected to interior space of housing. An engagement system located within interior space. Engagement system, control system, signaling system and an air circulation system are cooperatively interconnected. A player area is located within the interior space and positioned proximate the engagement system wherein contact by player with engagement system initiates a sequence of instructions from the control system to initiate the delivery of air into interior space by air circulation system for circulation of prizes within interior space. A signal to player is sent via signaling system to discontinue player contact with engagement system so player may interact with the prizes circulating in the interior space for the purpose of removing the prizes from the housing via the interior space.

27 Claims, 10 Drawing Sheets

AMUSEMENT APPARATUS

CROSS REFERENCE TO RELATED APPLICATIONS

Applicant claim priority under 35 U.S.C. §119(e) of provisional U.S. Patent Application Ser. No. 60,857,947 filed on Nov. 10, 2006 entitled "Improved Money Machine" which is incorporated by reference herein.

FIELD OF THE INVENTION

The present invention relates to a method and apparatus to improve fan driven money (prize) circulation machines. The present device is envisioned to be used in and for gambling, participant enjoyment, entertainment and or charitable or fundraising projects.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)(c)

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION—BRIEF DESCRIPTION OF THE FIGURES

SUMMARY OF THE INVENTION

Figure 1:
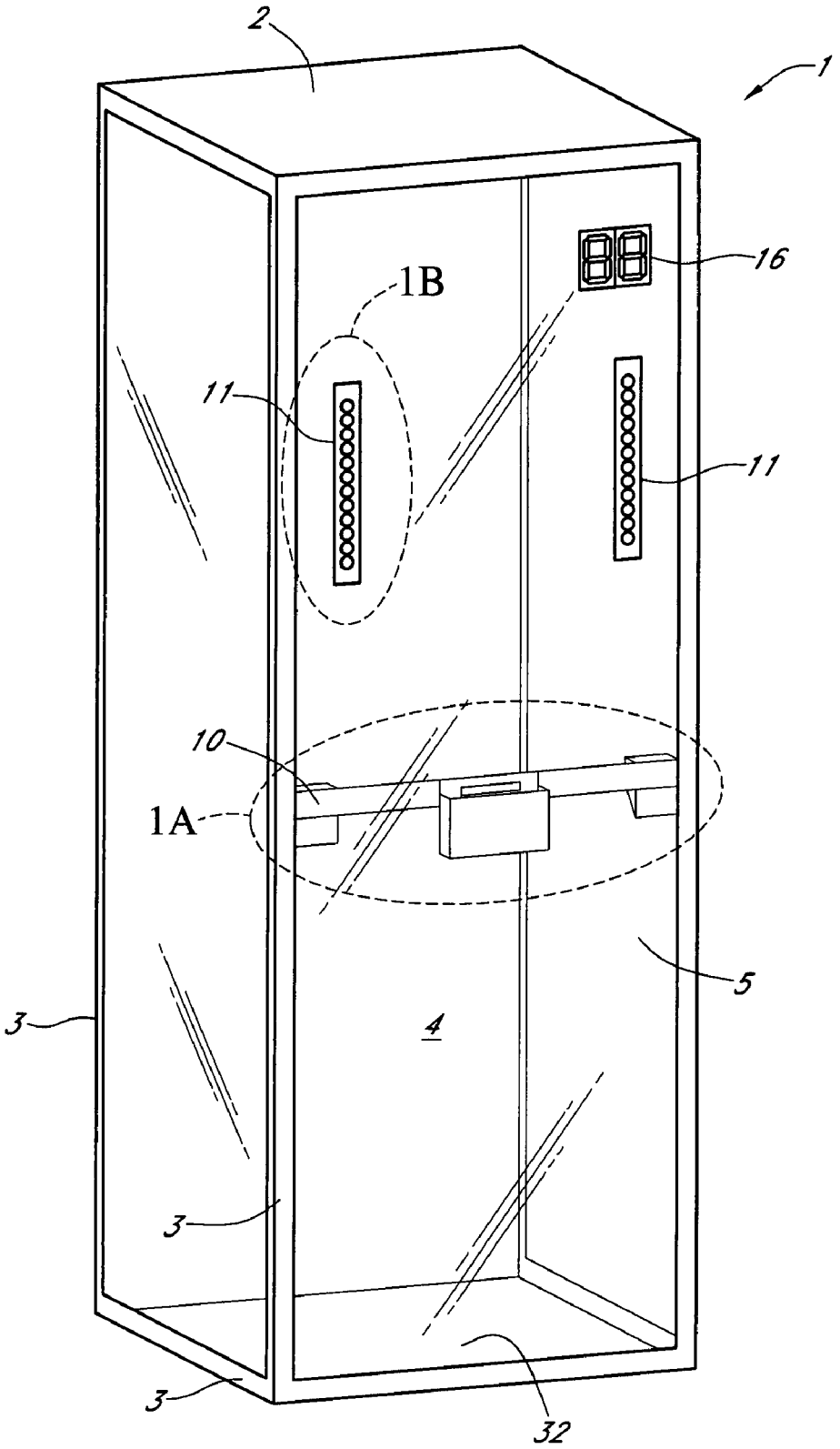
FIG. 1 is an isometric view of one embodiment of an amusement apparatus.

An amusement apparatus 1 commonly referred to as a "Money Machine" because many times it circulates actual currency, is disclosed and claimed herein. As generally illustrated in FIGS. 1-8, the amusement apparatus 1 comprises a housing 2 having a frame 3 containing an interior space 4. A door 5 is typically attached to the frame 3 of the housing 2 to allow entry of a human player 6 having arms 7 into the interior space 4. Typically, the housing 2 is composed of transparent or substantially materials such as Lexan® plastic or glass. The present invention is not limited to such materials but it is known in the prior art that the use of transparent materials increases enjoyment for non-players 33 exterior to the housing who may enjoy watching a player furiously "grab" for money circulated within the interior space 4. Although most money machines used have a rigid frame, a flexible frame type, composed primarily of a plastic bag mounted to a base has been patented. See U.S. Pat. No. 5,794,944 "Money Machine", which is incorporated by reference herein, issued to Roberts for more background on this subject. The disclosure of the present art is not limited to a rigid frame as illustrated in the accompanying figures. The features disclosed and claimed herein may also be incorporated in designs having flexible frame type as disclosed in U.S. Pat. No. 5,794,944.

The embodiment of the amusement apparatus and method of using same illustrated herein and as exemplified in FIGS. 1-8 solves multiple problems that are inherent in the prior art. One problem solved is that of player control and the avoidance of player cheating. Another problem solved is increasing audience participation. "Money machines" as found in the present art are genuinely entertaining and enjoyable for the player 6 and non-player(s) or audience that may be watching. The prize 20 won by "money machine" player 6 is based in part on chance and in part on skill. For example, a player 6 having long arms 7 and excellent hand eye coordination (not shown) can gather more prizes 20 (i.e. money) during the time allowed than a player 6 having short arms and poor hand eye coordination (not shown). This is an acceptable part of amusement apparatus operation. The opportunity for a player 6 to get "lucky" based on that particular individual player's skill adds to the drama and entertainment of the game for the player 6 and the non-player(s) 22 watching. The lure of getting "lucky" in the prior art amusement apparatus, however, has been known to tempt those of less than sterling character to "cheat."

A common way that player's may cheat money machines of the prior art is to begin grabbing at the circulating prizes 20 before the air blower has fully delivered the amount of air necessary to fully and uniformly distribute and circulate the prizes within the money machines of the prior art. The opportunity for a player 6 to cheat decreases the predictability of player outcomes and thus a prospective money machine owner's enthusiasm for investing in a money machine or increasing the potential to win large sums by legitimate play of the game. The money machine game of the prior art is also entertaining to those watching but at present does not fully engage or induce audience participation or anticipation.

Upon activation of the game start sequence, the air blower starts and air flow into the transparent cube begins. After the air blower starts, there is a period of time where the bills are not circulating properly and a player may simply grab them off the floor. The density of the circulating bills is high at this time so every grab by the player produces an increased number of bills in comparison to when the air is properly circulating. In the prior art, a player would take advantage this lower flow rate for increased gains. Or after playing once, the player may realize that at the start of the game the bills will clump in a dense "ball" thereby increasing the potential for excess recovery by grabbing at the floor. No skill or luck is involved at this point.

Figure 5:
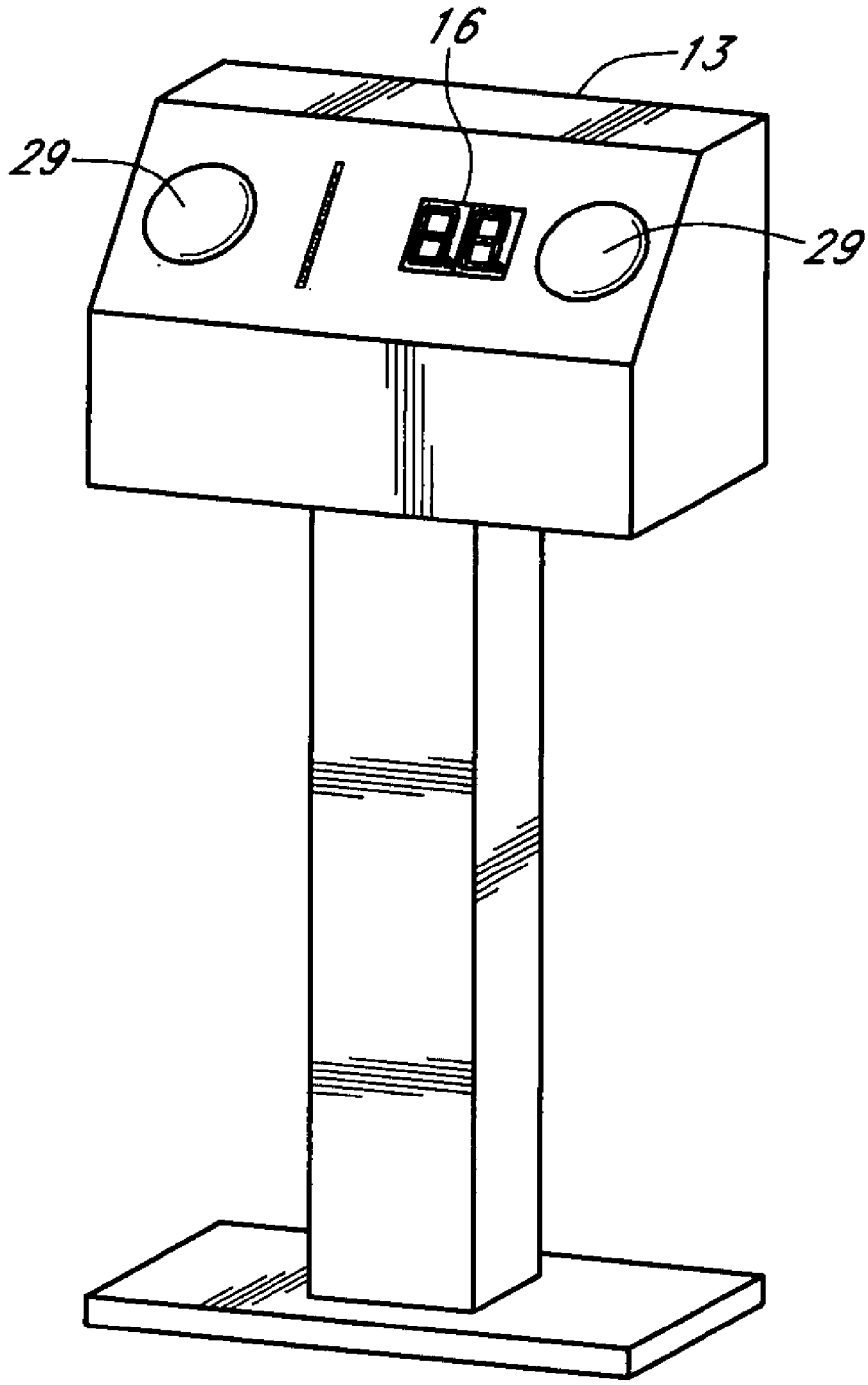
FIG. 5 is a detailed view of another embodiment of an engagement system for an amusement apparatus from the perspective of a player.
Figure 6:
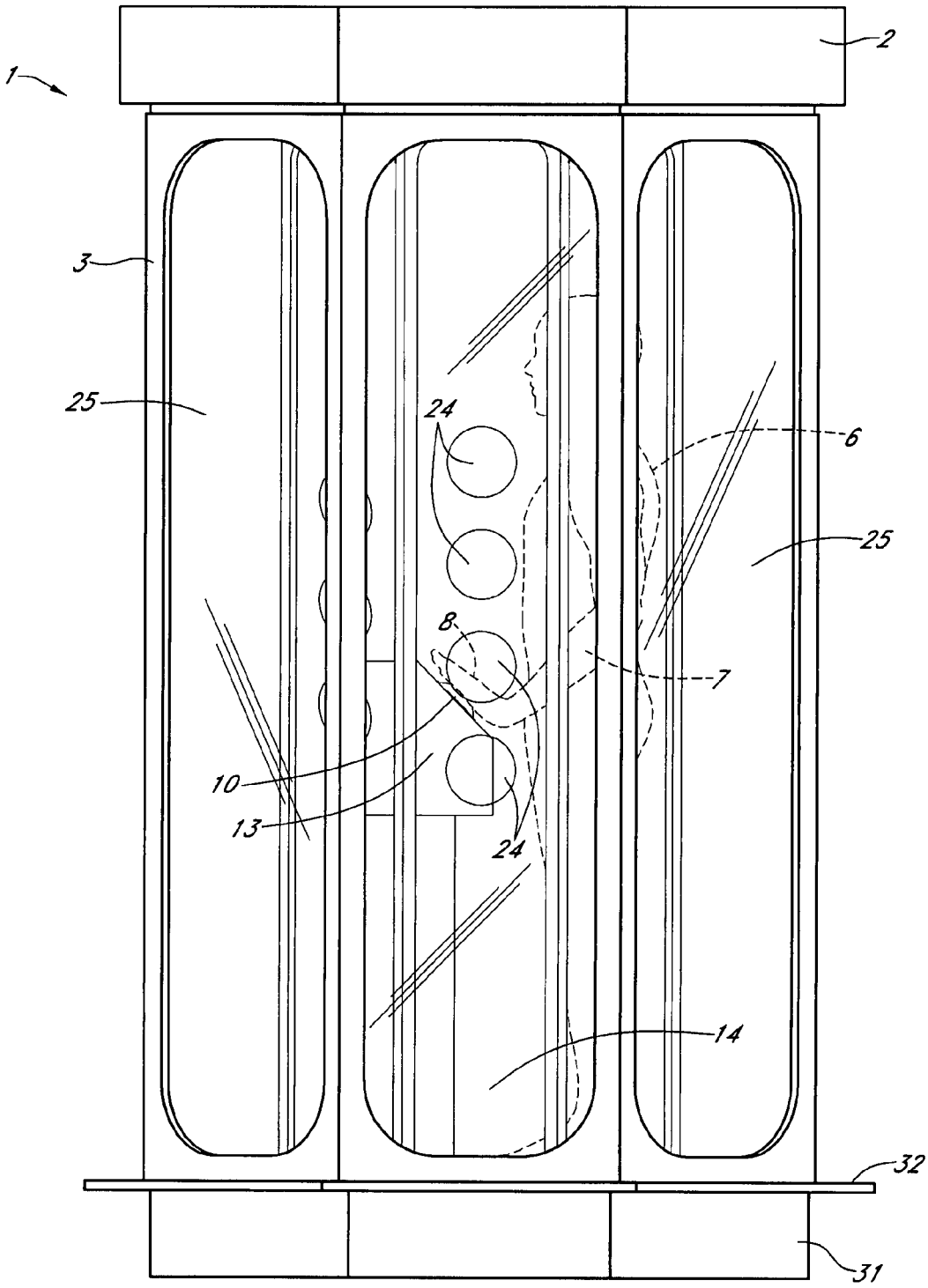
FIG. 6 is a left-side rear perspective view of the embodiment of the amusement apparatus of FIG. 3 with a player contacting the engagement system.

In the present art having FunStart™ technology, the player must continue to contact or engage the engagement system 10 incorporating FunStart™ technology located within the interior space 4 (as illustrated by the player console 13 as shown in FIG. 5) until allowed to disengage the engagement system 10 at which time prize 20 circulation is uniform. If the player 6 does not follow the preceding protocol, the air circulation system 9 will stop and the game will be over before it begins. An advantage of the present art then is to increase in consistency of the results. This allows an opportunity to create other hybrid uses for the amusement apparatus 1.

The amusement apparatus 1 disclosed herein is designed to generate excitement on both the part of the users and audience the surrounding the money machine. This concept is well known in the prior art, thus the use of transparent glass or Lexan® plastic for walls of the money machine. The present art takes audience participation one step further by increasing communication with the audience regarding the game to be played.

As embodied by FIGS. 1-8, the amusement apparatus of the present art may be configured with a "Christmas Tree" type lighting concept for enhanced audience participation. Similar to the lighting system used at a drag strip to coordinate and initiate the start of a drag race to a driver, the Christmas tree lighting system of the present art works with the hand based FunStart™ player control system to communicate to the audience that play is about to begin through an illuminated countdown system. Applicant has branded this feature as FunVision™ and is one embodiment of a signaling system 11 as found in the present art. This system may be integrated with a countdown timer on the player controls. This can be accomplished through a combination of a countdown timer and lights of changing color. Although not shown, but understood by those of ordinary skill in the art, FunVision™ may be further enhanced through the addition of an audio system. It is also possible with FunVision™ as disclosed in the present art to include additional game features such as the amount played for, the amount won or increase audience enjoyment by including novelty theme based sounds. This technology of the amusement apparatus builds both audience and player anticipation and excitement.

Method of Operation—FunStart™ and FunVision™

1. Player enters the interior space of the amusement apparatus.
2. Player contacts the engagement system FunStart™ buttons.
3. FunStart™ logic controls confirm player control and engagement and initiation start-up sequence.
4. FunVision™ alerts player and audience to initiation of play.
5. FunStart™ logic initiation start-up sequence for air blower.
6. Upon air flow levels reaching operational flow rates necessary to uniformly circulate cash, FunVision™ signals player and audience initiation of play.
7. Player seeks to grab as much cash as possible during time available as tracked by FunVision™ and controlled by FunStart™ logic system.
8. At the expiration of pre-defined or programmed play time, FunStart™ logic shutdowns air blower; FunVision™ signals player and audience end of play.
9. If equipped, play data is collected and transmitted to unit hard drive or uploaded to Applicant's server. Optionally, an attendant may verify the cash won and replace cash as necessary to maintain available cash for next play.

Method of Operation—MegaCube™ with VolumeMax™ Prize Hopper

1. A player enters the player space (Player Pod™) of the amusement apparatus.
2. A player engages FunStart™ buttons.
3. FunStart™ logic controls confirm player control and engagement and initiates start-up sequence.
4. FunVision™ alerts player and audience to initiation of play.
5. FunStart™ logic initiation start-up sequence for air blower.
6. Upon air flow levels reaching operational flow rates necessary to uniformly circulate cash, FunVision™ signals player and audience initiation of play.
7. Player seeks to grab as much cash as possible during time available as tracked by FunVision™ and controlled by FunStart™ logic system.
8. At the expiration of pre-defined or programmed play time, FunStart™ logic shutdowns air blower; FunVision™ signals player and audience end of play.
9. If equipped, play data is collected and transmitted to unit hard drive or uploaded to Applicant's server via a computer network. Optionally, an attendant may verify the cash won and replace cash as necessary to maintain available cash for next play.

Those of ordinary skill in the arts will appreciate that the FunStart™ and FunVision™ technologies may be implemented in the amusement apparatus by any number of methods and apparatus including electromechanical means, mechanical switches, push buttons, touch screens, programmable logic controllers, computer processors, software, and combinations thereof. By way of illustration, and without limitation, U.S. Pat. No. 6,850,252 entitled "Intelligent electronic appliance system and method", which is incorporated by reference herein, provides a thorough review of human interfaces with electronic appliances of which, the present art may be embodied.

U.S. Pat. No. 3,746,815 entitled "Off Locking Trigger Switches"; U.S. Pat. No. 5,184,534 entitled "Operation safety device for a portable power tool"; U.S. Pat. No. 5,401,928 "Safety control for power tool"; U.S. Pat. No. 5,681,214 entitled "Hand power tool" and U.S. Pat. No. 6,105,348 entitled "Safety cut-off system for use in walk-behind power tool" serve to enable the present art and provide representative illustrations of the number of ways one of ordinary skill in the art could implement the teachings of the present art. The preceding patents are incorporated by reference herein.

DETAILED DESCRIPTION—LISTING OF ELEMENTS

| ELEMENT DESCRIPTION | ELEMENT # |
|---|---|
| Amusement Apparatus | 1 |
| Housing | 2 |

-continued

| ELEMENT DESCRIPTION | ELEMENT # |
|---|---|
| Frame | 3 |
| Interior Space | 4 |
| Door | 5 |
| Player | 6 |
| Arms | 7 |
| Hands | 8 |
| Air Circulation System | 9 |
| Engagement System | 10 |
| Signaling System | 11 |
| Control System | 12 |
| Console | 13 |
| Player Area | 14 |
| Signal | 15 |
| Timing System | 16 |
| Data System | 17 |
| Computer Network | 18 |
| Remote Location | 19 |
| Prizes | 20 |
| Data Transmission System | 21 |
| Non-player | 22 |
| Divider | 23 |
| Divider Opening | 24 |
| Circulation Area | 25 |
| Prize Box | 26 |
| Opening Prize Box | 27 |
| Engagement Means | 28 |
| Button | 29 |
| Lights | 30 |
| Pedestal | 31 |
| Floor | 32 |

DETAILED DESCRIPTION

Figure 1A:
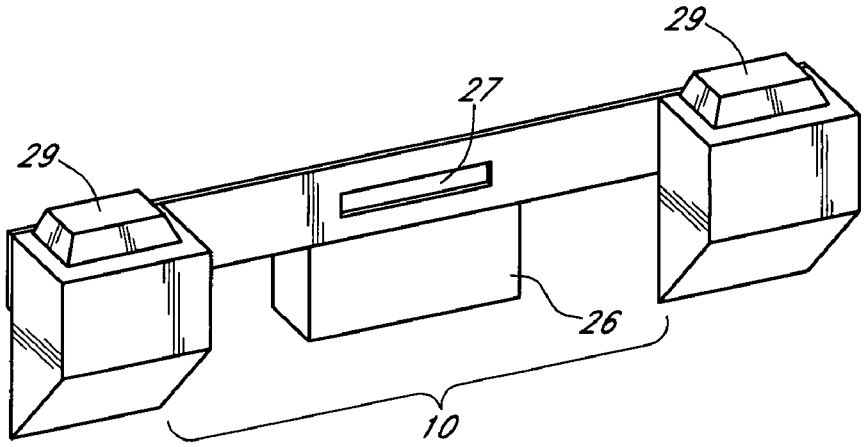
FIG. 1A is a detailed view of one embodiment of an engagement system for the amusement apparatus of FIG. 1.
Figure 1B:
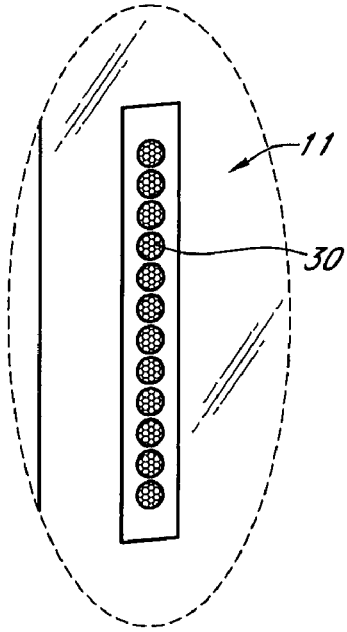
FIG. 1B is a detailed view of one embodiment of a signaling system for the amusement apparatus of FIG. 1.
Figure 2:
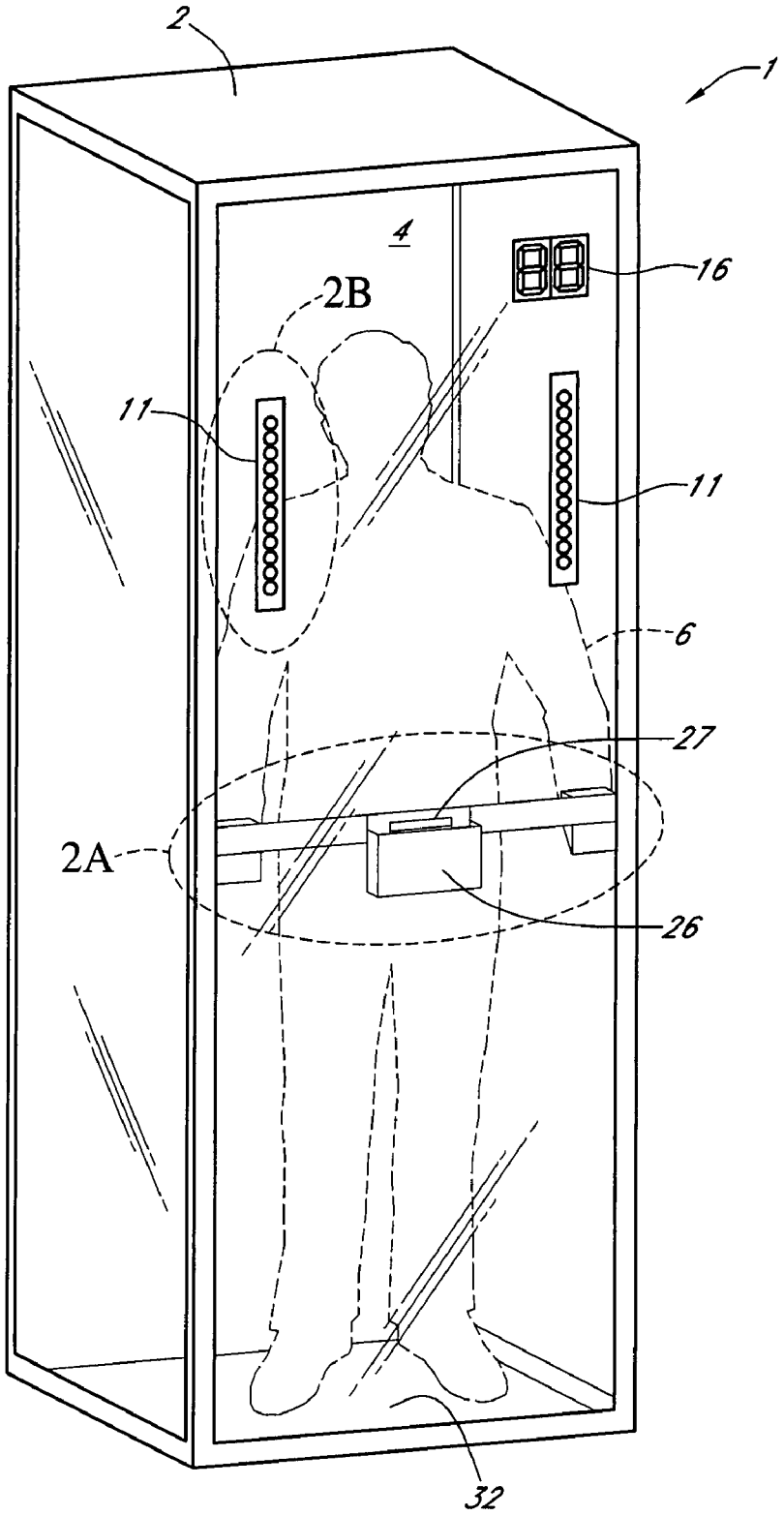
FIG. 2 is an isometric view of one embodiment of an amusement apparatus with a player positioned therein.
Figure 2A:
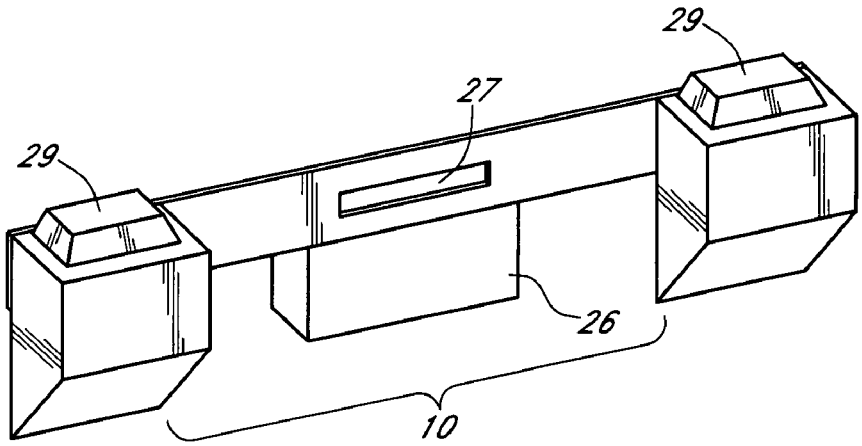
FIG. 2A is a detailed view of one embodiment of an engagement system for the amusement apparatus of FIG. 2.
Figure 2B:
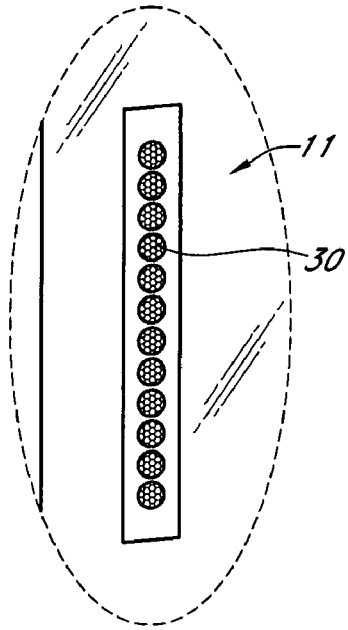
FIG. 2B is a detailed view of one embodiment of a signaling system for the amusement apparatus of FIG. 2.

FIGS. 1, 1A and 1B illustrate a first embodiment of the present art. As illustrated in FIG. 1, the amusement apparatus 1 has a cube like shape and is equipped with an engagement system 10 and a signaling system 11. An air circulation system 9 is fluidly connected to the interior space 4 of the housing 2, as is known to those of ordinary skill in the art. The air circulation system 9 may be further comprised of an air blower (not shown) which is fluidly connected to the housing 2. Typically, as is known in the prior art, the air is forced by an air blower located next to or under the housing 3 with vents placed in the floor 32 for the purpose of allowing the forced air to enter the interior space 4 of the housing 2. (not shown) When the air blower is activated, air is blown into the interior space 4 to cause whatever material is in the amusement apparatus 1 to circulate. Typically, a plurality of prizes 20 are placed inside the housing 2, a player 6 enters the interior space 4, the air blower (not shown) is turned on and the player 6 has a fixed period of time in which to grab as many circulating prizes 20 as possible within the fixed period of time. FIGS. 2, 2A and 2B depict a player in relation to the embodiment illustrated in FIGS. 1, 1A and 2A. In the embodiment illustrated in FIGS. 1-2, a player 6 may grab prizes 20 from anywhere within interior space 4 during circulation of the prizes 20.

Additionally, the present art, as found in FIGS. 1-8, provides for an engagement system 10 to be located within the interior space 4. The engagement system 10 is cooperatively engaged with a signaling system 11, a control system 12 and the air circulation system 9. A segregated player area 14 located within the interior space 4 and positioned proximate the engagement system 10 is disclosed in FIGS. 3-8. As found in the present art, and not previously taught or disclosed by the prior art, contact by the player 6 with the engagement system 10 initiates a sequence of instructions from the control system 12 that initiate the delivery of air into the interior space 4 by the air circulation system 9 for circulation of prizes 20 within the interior space 4. Then, a signal 15 is sent to the player 6 via the signaling system 11 for the player 6 to discontinue contact with the engagement system 10. This allows the player 6 to begin interacting with the prizes 20 circulating in the interior space 4 (i.e. player 6 grabs the circulating prizes 20) for the purpose of removing prizes 20 from the housing 2 via the interior space 4. Applicant has branded this FunStart™ technology.

As better shown in FIG. 1A, a player 6 would interact with the engagement system 10 through the button(s) 29 located on either side of the housing 2 in the interior space 4. In this embodiment, the amusement apparatus 1 also has a timing system 16 interconnected with the control system 12 (not shown) and air circulation system 9 (not shown). In this case, after a pre-determined amount of time has expired, as determined by the timing system 16, the control system 12 signals the end of play to player 6 through signaling system 11 and concurrently shuts down the air circulation system 9. Although not shown, the present art amusement apparatus 1 may be operated without a timing system 16 to shutdown the air circulation system 9. The player 6 would be still be required to contact or interact with the engagement system 10, but an external operator (not shown) may after a predetermined period of time, interact with the player 6 to send a signal 15 to the player 6 via the signaling system 11 to discontinue grabbing said prizes 20 circulating in said interior space 4 while concurrently shutting down the air circulation system 9. The embodiment illustrated in FIG. 1 and FIG. 1B illustrates that the signaling system 11 may be perceived by at least one non-player 22 external the interior space 4. Applicant has branded this technology "FunVision™" which will be explained in more detail herein. The signaling system and the timing system may be combined to further increase the excitement of the game. The amusement apparatus 1 may incorporate a signaling system 11 using lights, sounds, visual images, movie images and combinations thereof to generate excitement and increase audience participation. The amusement apparatus 1, in combination with a timing system 16 and a control system 12, may through signaling system 11 signal the end of play and concurrently shut down the air circulation system 9 to end play.

Figure 3:
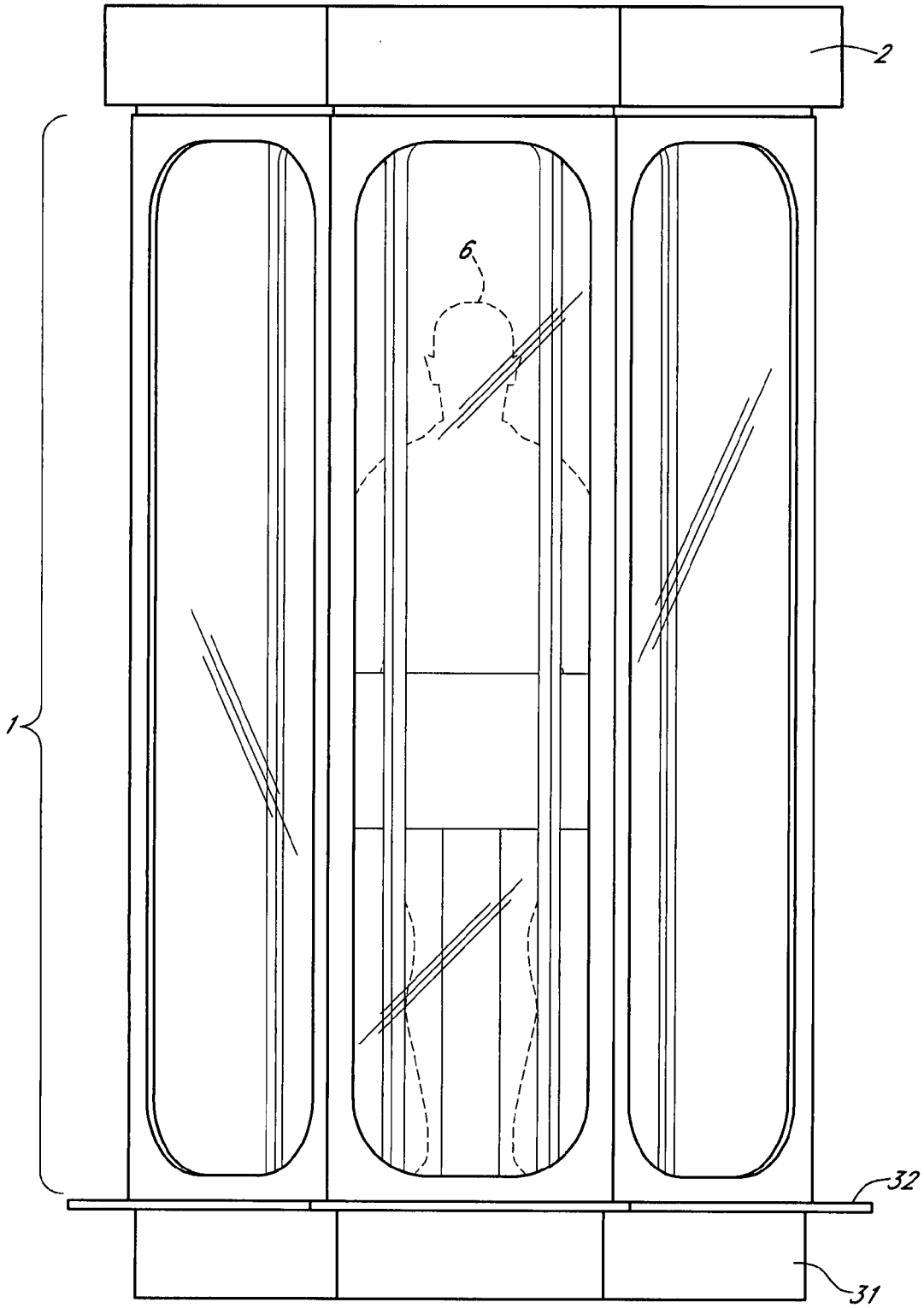
FIG. 3 is a front view of another embodiment of an amusement apparatus.
Figure 4:
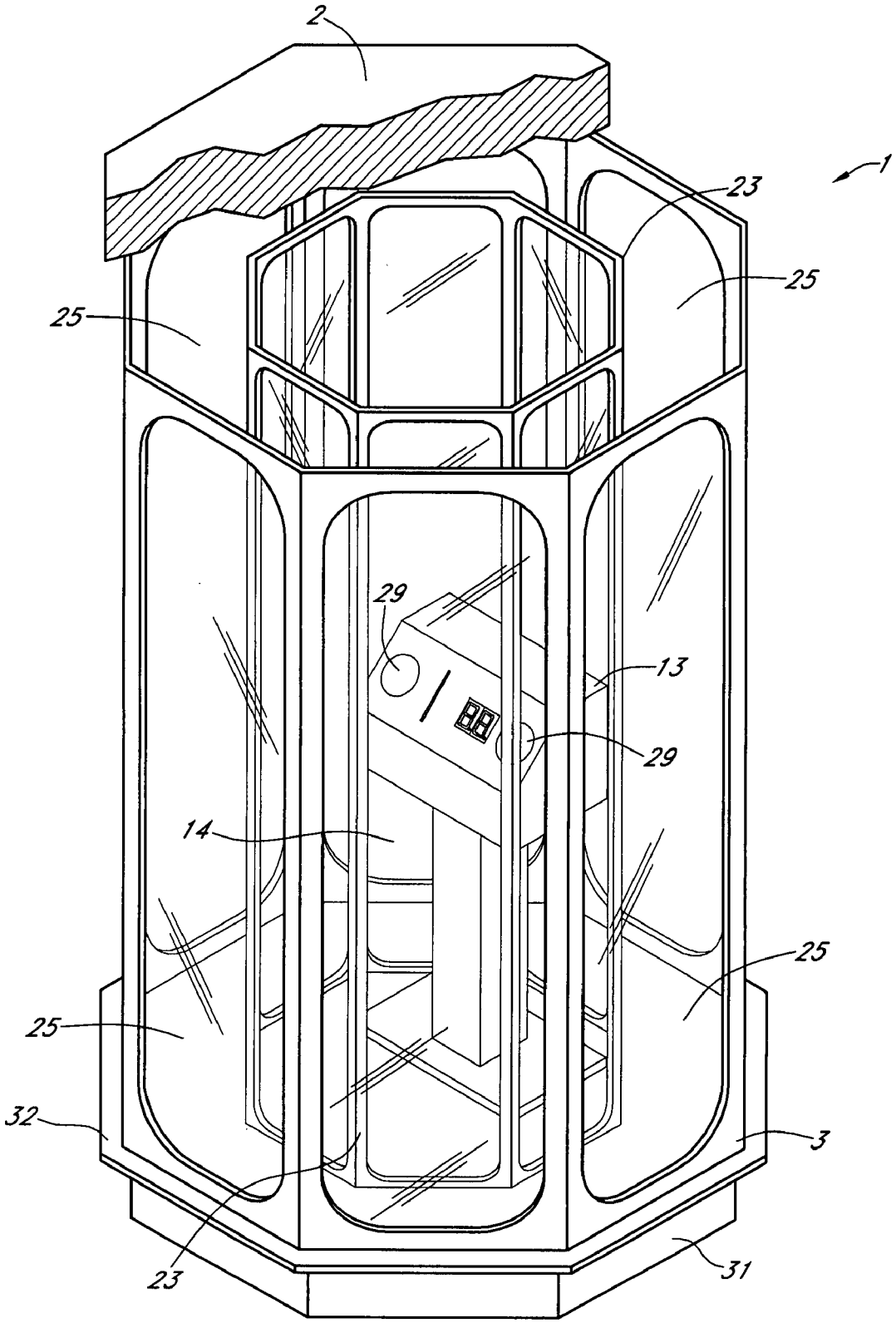
FIG. 4 is an isometric view of another embodiment of an amusement apparatus.

FIG. 3 illustrates the engagement system 10 may be activated by the player 6 through a set of buttons 29 mounted to a console 13 integrated into the interior of the transparent cube. This feature inhibits levels the playing field by controlling a player's ability to cheat. This feature is important to verify that all players' enjoy a level playing field to enhance the predictability of the game and the expected player winning percentages. Essentially, the FunStart™ technology does not allow a player to begin grabbing circulated prizes 20 until the prizes 20 are fully distributed and circulated within the housing 2 of the amusement apparatus 1. Game play does not begin until the player 6 inserts his or her hands into the recesses in the control panel and depresses or engages the buttons or knobs found therein to activate the game start sequence. As will be understood by one of ordinary skill in the art, the amusement apparatus 1 may be modified so that player 6 interacts with the engagement system 10 via any one of a number of engagement means 28 including pads, buttons 29, switches, pressure switches, joysticks and combinations therein which are all well known to those of ordinary skill in the arts. Although the embodiments shown incorporate both FunStart™ and FunVision™ technology, either technology may be implemented separately and independently with amusement apparatus 1 of the present art.

Another embodiment of the improved amusement apparatus 1 disclosed and claimed herein is illustrated in FIGS. 3, 4, 5, 6, 7 and 8. In this embodiment of an amusement apparatus 1, a divider 23 is placed within the interior space 4 to create a player area 14 and a circulation area 25 wherein only the player's arms 7 may be inserted into and through said divider opening 24 into said circulation area 25. As shown, this embodiment may be placed on a pedestal 31 to raise it off the ground or floor upon which it rests. The floor 32 of the amusement apparatus 1 sits above the pedestal 31. A portion of the air circulation system 9 may be placed under the pedestal 31 to reduce the footprint of the amusement apparatus 1 or to simply hide the air blower portion of the air circulation system 9. This embodiment of an amusement apparatus 1 may incorporate all of the features previously disclosed and discussed including FunStart™ and FunVision™ or it may stand alone. This embodiment of the present art creates two distinct and segregated spaces within one housing 2 which increase the prizes 20 available for circulation and reduce player 6 exposure to excess air velocities, as explained further below. Applicant has branded this configuration a "Mega Cube™." Although the Mega Cube of FIGS. 3-8 has a generally octagonal shape, it is not so limited and may take other shapes and forms. Applicant has found that the number of prizes 20 circulated in the form of bills in an amusement apparatus such as the embodiments found in FIGS. 1-2 reach an upper limit of approximately 200 bills. This limit is defined by the volume of space in the transparent cube (housing 2) and the amount of air necessary to properly fluidize bills for even distribution and circulation within the transparent cube. Applicant has found that at a constant air flow rate attempting to circulate an increasing number of bills above this number decreases bill distribution and results in unpredictable and inconsistent payouts. Increasing the air flow rate to compensate for the larger number of bills increases player exposure to the higher air velocities resulting increasing the potential for dislodgement of clothing, jewelry and injury to the player during play. This problem is further attenuated if the prize 20 circulated is something other than a paper bill such as a ping-pong ball (not shown) which is within the scope of the present art.

As illustrated in FIG. 3-8, the Mega Cube™ amusement apparatus of the present art creates two distinct spaces for improved play. The first space is a player area 14 (branded a Player Pod™ by Applicant) which provides a protective control space for engagement and control of the player 6. In addition to physical location, creation of this space allows for mental stimulation and control of the player. Stimulation may occur through interactive games, lighting or sounds as delivered by the signaling system 11. The Player Pod™ is located inside a large prize enclosure space (circulation area 25) which Applicant has branded the Volume Max Perimeter Diffusion™ space.

The Player Pod™ space allows mutual control of the player 6 and the game by controlling the player's range of motion. For example, the player 6 enters this space to initiate game play. The advantage of this space over the prior art is that the relative position of the player 6 within the game may be fixed prior to initiation of the game. Improved player control reduces the potential for cheating and increases the predictability of the game outcome. No air or prizes are circulated within the Player Pod™ (player area 14).

Figure 7:
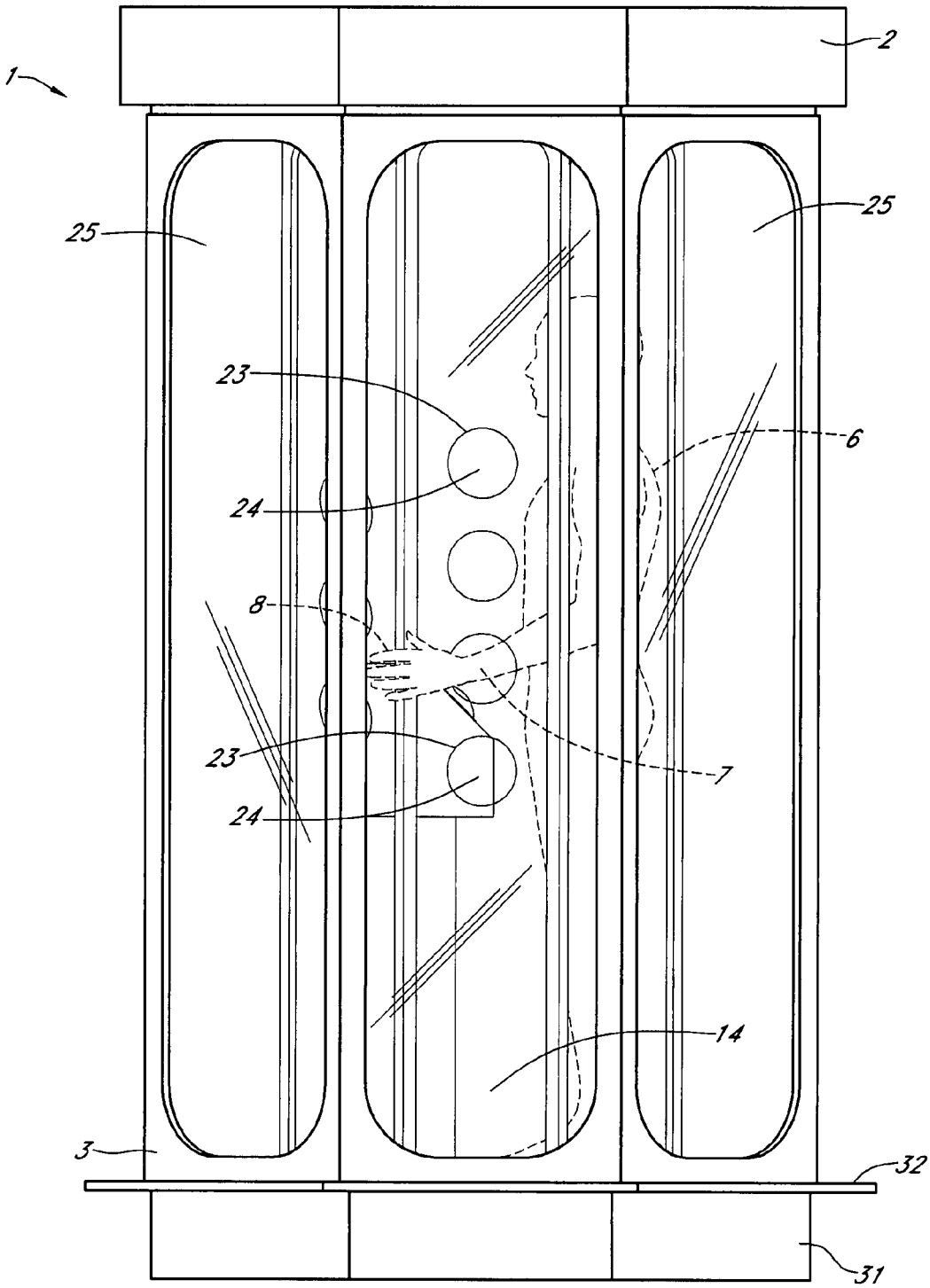
FIG. 7 is a left-side front perspective view of the embodiment of the amusement apparatus of FIG. 3 with a player extending their hand and a portion of their arm through the divider opening.
Figure 8:
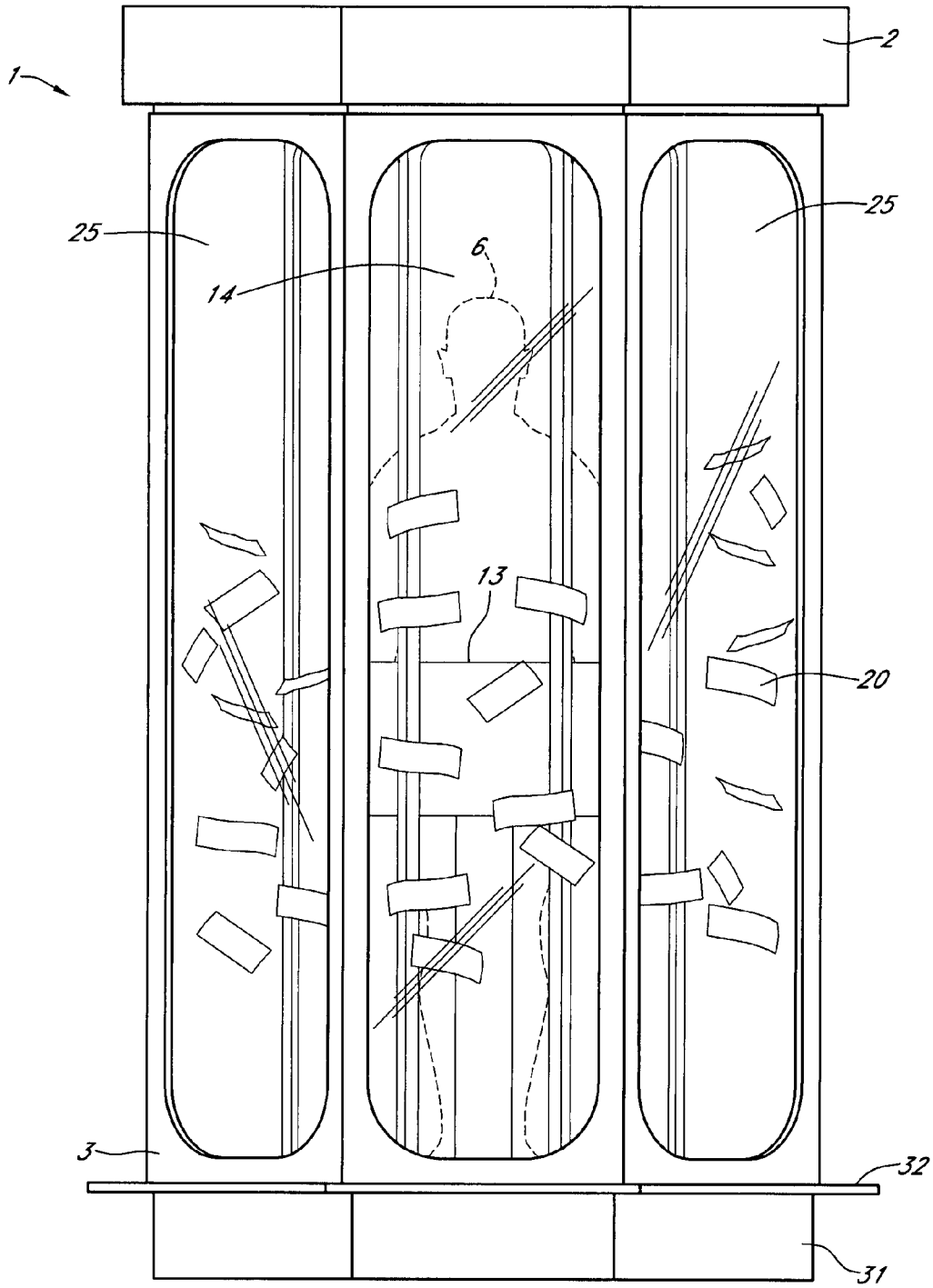
FIG. 8 is a front perspective view of the embodiment of the amusement apparatus during operation.

The Volume Max Perimeter Diffusion™ space (circulation area 25) creates a space exclusively for the circulation of the prizes 20. It is in this space that all prizes 20 to be circulated are available for the player 6 to grab from by inserting their hands 8 and a portion of their arms 7 through divider opening 24 as shown in FIG. 7. Creation of the circulation area 25, and segregation of the player 6 from the circulation area 25 (through divider 23 creating player area 14), improves the overall safety of the game for the player 6 by reducing player 6 exposure to excess air flow. Because an increasing number of bills (equating to prizes 20) require increased amounts of air, the failure of the prior art to address this issue reduced the potential number of bills that could be circulated and limited audience interest and participation. Because the participant is not subjected to, or exposed to, high air velocities or volumes, more air may safely be introduced into the amusement apparatus 1 for circulation which may translate to an increased opportunity for the player 6 to collect more prizes 20 i.e. more money is available for winning. This heightens both player 6 and non-player 22 interest. Applicant has found the practical upper limit of bill circulation has been increased by 5-10 times to at least 2000 bills with the creation of the separate circulation area 25 (VolumeMax Prize Hopper™). The prior art does not disclose or suggest this concept and would endanger participants if attempted. It should be noted that divider opening(s) 24 are shown as three individual openings for the purpose of matching up with players of short, medium and tall stature. It is within the scope of the present art to include divider openings 24 of other shape, sizes and orientations.

The segregated Player Pod™ and VolumeMax Prize Hopper™ of the MegaCube™ allows the amusement apparatus 1 of the present art to further increase player 6 and non-player 22 enjoyment by allowing a screen, a countdown timer and a keyboard to be placed into the Player Pod™. (Not shown) When combined with pre-loaded software and computer logic, new dimensions may be added to the amusement apparatus game. For example, the player may increase the time available to grab bills by answering trivia questions correctly. Thus, the amusement apparatus has an opportunity to become a one-man game show. In another variation allowed by the combination of features described herein, the additional number of prizes 20 may be released for circulation or the correct answers to questions may allow for initiation of the game, i.e. some correct answers are needed to initiate play. By providing a fully transparent player space in combination with FunVision™, a timing system 16, and television or LCD screens (not shown), non-player 22 participation is increased due to increased anticipation and enthusiasm generation. Other games of chance may also be included in the amusement apparatus game as disclosed herein.

The large space, transparency and computer controls allows for the integration of digital or analog cameras, web cams, audio systems and or communication(s) lines for broadcast to the Internet or TV. The present art would support a game show for mass distribution and broadcast through media channels such as television, satellite and Internet broadcast. As computer processors, software and programmable logic controllers are readily available, it will be apparent to one of ordinary skill that the control system 12 of the present art amusement apparatus may implemented through any one of the preceding elements and or combinations therein. Further, the amusement apparatus 1 control system 12 may also collect and store data generated from the operation of the amusement apparatus 1 in a data system 17 which is readily enabled by reference and the teachings of the prior art in the particular fields of computers, electronics and communications. The amusement apparatus 1 control system 12 may also be interconnected with a data transmission system 21 for connection to a computer network 18, such as the Internet, through a phone line or satellite, for the transmission of data generated from operation of said amusement apparatus to a remote location 19.

Another feature of the present art is the prize box 26. In this embodiment, the amusement apparatus 1 has a prize box 26 mounted in the interior space 4 and within reach of the player 6. The prize box 26 has an opening 27 and serves as a prize storage structure. As the player 6 collects prizes 20 during the game, the player 6 may "store" his or her prizes within the prize box 26. The prize box 26 is typically located proximate the engagement system 10 and the player area 14 within the interior space 4. See FIGS. 1A and 2A. The prize box 26 may be implemented in either of the configurations or embodiments disclosed and claimed herein without limitation. Although not shown, the prize box 26 may be detached for removal of prizes. The prize box may take other forms including a bag without departure from the present art.

The present art seeks to improve upon the prior art by enhancing the entertainment value of the game to both those playing and those watching. The elimination of cheating, increasing audience participation and the predictability of game outcome are all desired objectives of the present art.

In either game, actual currency may be substituted for bills having a prize value or "game" bills requiring exchange with the attendant for actual cash or prize value won through game play. Suitable prizes 20 include real currency of various denominations or "play" money of various denominations or coupons redeemable for cash or other goods may also be circulated within the interior space 4. Those skilled in the arts will appreciate that the prizes 20 circulated may be imprinted or coded for tracking with bar codes, magnetic strips, decodable light sensitive paper and combinations thereof. Typically, amusement apparatus 1 of this type are used for entertainment purposes such as fundraisers, parties for adults and children, and business promotional events. The present device has been described in its preferred embodiment. However, it would be obvious to one of ordinary skill in the art that modifications can be made without departure from the scope of the present invention. Also, the size of the present device, the frame and the base are illustrative and deemed to be the most practical, however, a change in sizing would be contemplated and considered an obvious modification.

The invention claimed is:

1. An amusement apparatus 1 comprising:

a. A housing 2 having a frame 3 and containing an interior space 4;

b. A door 5 attached to said frame 3 of said housing 2, said door 5 allowing entry of a player 6 having arms 7 into said interior space 4;

c. An air circulation system 9, said air circulation system 9 fluidly connected to said interior space 4 of said housing 2;

d. An engagement system 10 located within said interior space 4;

e. A signaling system 11;

f. A control system 12 wherein said engagement system 10, said control system 12, said signaling system 11 and said air circulation system 9 are cooperatively interconnected;

g. A player area 14 located within said interior space 4 and positioned proximate said engagement system 10 wherein contact by said player 6 with said engagement system 10 for a predetermined amount of time initiates a sequence of instructions from said control system 12 comprising:

i. Initiating delivery of air into said interior space 4 by said air circulation system 9 for circulation of prizes 20 within said interior space 4;

ii. Sending a signal 15 to said player 6 via said signaling system 11 to begin play and discontinue player contact with said engagement system 10 so that said player 6 may interact with said prizes 20 circulating in said interior space 4 for the purpose of removing said prizes 20 from said housing 2 via said interior space 4, wherein said air circulation system 9 is deactivated via said control system 12 if said player 6 does not maintain contact with said engagement system 10 during said predetermined amount of time.

2. The amusement apparatus according to claim 1 wherein a timing system 16 is interconnected with said control system 12 and said air circulation system 9.

3. The amusement apparatus according to claim 1 wherein said player 6 interacts with said engagement system via an engagement means 28 selected from the group consisting of pads, buttons, switches, joysticks and combinations thereof.

4. The amusement apparatus according to claim 2 wherein after a pre-determined period of play time, said control system 12 sends a signal 15 to said player 6 via said signaling system 11 to discontinue grabbing said prizes 20 circulating in said interior space 4 while concurrently shutting down the air circulation system 9.

5. The amusement apparatus according to claim 1 wherein said signaling system 11 may be perceived by at least one non-player 22 external said interior space 4.

6. The amusement apparatus according to claim 1 wherein said signaling system 11 is selected from the group consisting of lights, sounds, visual images, television images and combinations thereof.

7. The amusement apparatus according to claim 2 wherein said signaling system 11 is selected from the group consisting of lights, sounds, visual images, television images and combinations thereof.

8. The amusement apparatus according to claim 3 wherein after a pre-determined amount of play time has expired, said control system 12 signals the end of play and concurrently shuts down said air circulation system 9.

9. An amusement apparatus according to claim 1 wherein said control system 12 is selected from a computer processor, software, a programmable logic controller and combinations thereof.

10. An amusement apparatus according to claim 1 wherein said control system 12 collects and stores data generated from the operation of said amusement apparatus in a data system 17.

11. An amusement apparatus according to claim 10 wherein said control system 12 is interconnected with a data transmission system 21 connected to a computer network 18 for the transmission of data generated from operation of said amusement apparatus to a remote location 19.

12. An amusement apparatus according to claim 1 wherein a divider 23 is placed within said interior space 4 to create a player area 14 and a circulation area 25 wherein only said player's arms 7 may be inserted into and through said divider opening 24 into said circulation area 25.

13. The amusement apparatus according to claim 1 wherein said housing 2 and door 3 are substantially transparent.

14. The amusement apparatus according to claim 1 wherein a prize storage structure 26 having an opening 27 is located proximate said engagement system 10 and said player area 14 within said interior space 4 for collection and storage of prizes 20 collected by said player 6.

15. The amusement apparatus according to claim 14 wherein a prize storage structure 26 having an opening 27 is located proximate said engagement system 10 and said player area 14 within said interior space 4 for collection and storage of prizes 20 collected by said player 6.

16. A method of amusement comprising:

a. Selecting a player 6 for entry into an amusement apparatus 1 wherein said amusement apparatus 1 further comprises:

i. A housing 2 containing an interior space 4 and a door 5 for entry of a player 6 into said interior space 4;

ii. An air circulation system 9, said air circulation system 9 fluidly connected to said interior space 4 of said housing 2;

iii. A console 13 located within said interior space 4, said console 13 having an engagement system 10 and a control system 12 wherein said engagement system 10, said control system 12 and said air circulation system 9 are cooperatively interconnected;

b. Fixing the position of said player 6 within said interior space 4 and proximate said console 13;

c. Fixing the position of said player's hands 8 in relation to said player area 14 using said console 13 having an engagement system 10;

d. Initiating the delivery of air into said interior space 4 by said air circulation system 9 for circulation of prizes 20 within said interior space 4;

e. Signaling said player 6 to begin play and discontinue engagement with said engagement system 10 so that said player 6 may interact with said prizes 20 circulating in said interior space 4 by grabbing said prizes 20 with said player's hands 8 for the purpose of removing said prizes 20 from said housing 2 via said interior space 4;

f. Disqualifying said player 6 from continuing play by deactivating said air circulation system 9 via said control system 12 if said player 6 does not maintain continuous contact with said engagement system 10 after contact with said engagement system 6 but prior to receiving said signal to discontinue contact with said engagement system 10.

17. The method of amusement according to claim 16 wherein the time the player 6 is allowed to grab said prizes 20 for the purpose of removing said prizes 20 from said housing 2 via said interior space 4 is pre-determined and controlled external of said amusement apparatus 1.

18. The method of amusement according to claim 16 wherein the time the player 6 is allowed to grab said prizes 20 for the purpose of removing said prizes 20 from said housing 2 via said interior space 4 is pre-determined and controllable through input to said amusement apparatus 1.

19. The method of amusement according to claim 16 wherein said housing 2 and door 3 are substantially transparent.

20. The method of amusement according to claim 16 wherein said amusement apparatus has a timing system 16 and wherein said timing system is interconnected with said control system 12 and said air circulation system 9.

21. The method of amusement according to claim 16 wherein said amusement apparatus has a signaling system 11 selected from the group consisting of lights, sounds, visual images, video images and combinations thereof.

22. The method of amusement according to claim 16 wherein said amusement apparatus control system 12 is selected from a computer processor, software, a programmable logic controller and combinations thereof.

23. The method of amusement according to claim 16 wherein said amusement apparatus control system 12 collects and stores data generated from operation of said amusement apparatus 1.

24. The method of amusement according to claim 16 wherein said amusement apparatus control system 12 is interconnected with a data transmission system 21 connected to a computer network 18 for the transmission of data generated from operation of said amusement apparatus to a remote location 19.

25. The method of amusement according to claim 16 wherein said amusement apparatus 1 has a divider 23 placed within said interior space 4 to create a player area 14 and a circulation area 25 and wherein said divider 23 has a divider opening 24 sized to allow insertion of said player's arms 7 into and through said divider opening 24 and into said circulation area 25.

26. The method of amusement according to claim 16 wherein said amusement apparatus engagement system 10 has an engagement means 28 for player 6 interaction selected from the group consisting of pads, buttons, switches, joysticks and combinations thereof.

27. An amusement apparatus 1 comprising:

a. A housing 2 having a frame 3 and containing an interior space 4;

b. A door 5 attached to said frame 3 of said housing 2, said door 5 allowing entry of a player 6 having arms 7 into said interior space 4;

c. An air circulation system 9, said air circulation system 9 fluidly connected to said interior space 4 of said housing 2;

d. A console 13 located within said interior space and wherein said console 13 has an engagement system 10;

e. A signaling system 11;

f. A control system 12 having a timing system 16 and wherein said engagement system 10, said control system 12 and said air circulation system 9 are cooperatively interconnected;

g. A player area 14 located within said interior space 4 and positioned proximate said engagement system 10 wherein engagement by said player 6 with said engagement system 10 initiates a sequence of instructions from said control system 12 comprising:

i. Initiating the delivery of air into said interior space 4 by said air circulation system 9 for circulation of prizes 20 within said interior space 4;

ii. Sending a signal 15 to said player 6 to discontinue contact with said engagement means 28 so that said player 6 may interact with said prizes 20 circulating in said interior space 4 for the purpose of removing said prizes 20 from said housing 2 via said interior space 4;

iii. Disqualifying said player 6 from play by deactivating said air circulation system 9 via said control system 12 and ending game if said player 6 does not maintain continuous contact with said engagement system 10 after contact with said engagement system 6 but prior to receiving said signal to discontinue contact with said engagement system 10.

h. A data system 17 for collection and storage of data generated by operation of said amusement apparatus 1;

i. A data transmission system 21;

j. A source of electrical power wherein said air circulation system 9, said timing system 16, said control system 12, said engagement system 10, said signaling system 11, said data system 17, and said data transmission system 21 are electrically interconnected and wherein any data generated during operation of said amusement apparatus 1 may be collected and transmitted through said data transmission system 21 connected to a computer network 18 to a remote location 19.

* * * * *